US008588446B2

(12) United States Patent
Brunda

(10) Patent No.: US 8,588,446 B2
(45) Date of Patent: Nov. 19, 2013

(54) SHIELDING OF BEHIND-THE-EAR HEARING AIDS

(76) Inventor: Daniel D. Brunda, Ewing, NJ (US)

( * ) Notice: Subject to any disclaimer, the term of this patent is extended or adjusted under 35 U.S.C. 154(b) by 894 days.

(21) Appl. No.: 12/344,865

(22) Filed: Dec. 29, 2008

(65) Prior Publication Data

US 2010/0166239 A1 Jul. 1, 2010

(51) Int. Cl.
*H04R 25/00* (2006.01)

(52) U.S. Cl.
USPC ..... 381/322

(58) Field of Classification Search
USPC ..... 381/322
See application file for complete search history.

(56) References Cited

U.S. PATENT DOCUMENTS

| | | | | |
|---|---|---|---|---|
| 5,654,530 | A * | 8/1997 | Sauer et al. | 181/130 |
| 5,708,720 | A * | 1/1998 | Meyer | 381/322 |
| 7,123,733 | B1 * | 10/2006 | Borowsky et al. | 381/322 |
| 2004/0196996 | A1 * | 10/2004 | Feitel | 381/322 |

* cited by examiner

*Primary Examiner* — Anthony Ho
(74) *Attorney, Agent, or Firm* — Perry M. Fonseca

(57) ABSTRACT

Provided is a method and shield for shielding a behind-the-ear hearing aid. A Mu metal shielding material is bonded to the external or internal surface of the behind-the-ear hearing aid, the shielding providing effective shielding of electromagnetic radiation in the frequency range of 20 Hz to 1,600 MHz and effective sound shielding in the audio frequency range of 20 Hz to 20,000 Hz. A hearing canal mold comprised of a rubber-like compound, shaped to encompass and seal an outer portion of a hearing tube of a hearing aid and a user's hearing canal entrance is also provided.

17 Claims, 4 Drawing Sheets

SHIELDING OF BEHIND-THE-EAR HEARING AIDS

FIELD OF THE INVENTION

This invention generally relates to the effective reduction of electromagnetic radiation and sound emanating from behind-the-ear hearing aids, and, more particularly, to reduction of electromagnetic radiation in the range of about 20 Hz to 1,600 MHz, and sound in the human audible range of approximately 20 Hz to 20,000 Hz.

BACKGROUND OF THE INVENTION

Hearing aids have been in use by those with hearing loss or impairment for many decades. Advances in miniaturization of electrical components have allowed hearing aids to become small in size, to the point where the hearing aid can be mounted proximal to the ear itself. Behind-the-ear hearing aids are hearing aids which fit mostly behind the user's ear, remaining at least partially hidden from view.

In most behind-the-ear hearing aids, the main electrical components are located behind the user's ear, with a hearing tube or equivalent protruding from behind the ear to or into the hearing canal itself. In this position, the main electrical components of behind-the-ear hearing aids tend to rest alongside the user's head, proximal to the user's brain.

Many electrical devices output electromagnetic frequency radiation of various strength and frequency. Several of the electrical components of hearing aids emit various wavelengths of electromagnetic radiation. For example, cellular telephones, mobile telephones, pagers, and other small, handheld devices emit electromagnetic radiation in the range of 20 Hz to 1,600 MHz.

Thanks in part to recent anecdotal stories, particularly with respect to cellular telephones, there is a growing public understanding of the dangers of operating small unshielded electronic devices in close proximity to a user's brain.

For a detailed discussion of the human effects from unshielded electronic devices, see "Power Line Radiation, Your Genes, Hereditary Diseases, The Unified Nature Of Electromagnetic Radiation, Energy And Control And The Radiation Limits Of Human Beings" by Daniel Donald Brunda DDG LFIBA MOIF IOM, ISBN: 1-4134-3084-8, hereinafter "*Brundal*", which is incorporated herein by reference. Pages 11 and 12 from *Brundal*, which include Table 1, list exemplary electromagnetic sources and physical injuries thereto attributable, and Appendix B, which is the reference section of *Brundal*.

Another publication, "The Design of Safe Electrical Transmission and Distribution Lines, Electromagnetic Powerline Radiation Engineering", also by Daniel Donald Brunda DDG LFIBA MOIF IOM, ISBN: 1-4010-8922-4, is also incorporated herein by reference.

There is also an informative article by Lynn Quiring, RPh, CCN, NMD of Logical Health LLC, 1163E. Geronimo Place, Chandler, Ariz. 85225, entitled "the Cell Phone Poisoning of America", hereinafter the "Quiring Article"), which is also incorporated herein by reference. Although focused on cellular telephones, the Quiring Article includes a great deal of information regarding the probable and possible negative effects on humans from EMR, such as produced by small electronic devices.

In addition, manufacturers of cellular telephones and other small electronic devices are using EMR shielding materials to reduce EMR.

Thus, there is a need for electromagnetic radiation ("EMR") shielding for a behind-the-ear hearing aid, specifically in the frequency range of 20 Hz to 1,600 KHz.

In addition, hearing aids generally work by amplifying sounds for transmission to the hearing canal. These sounds are intentionally audible, but being amplified, may actually be intercepted by a nearby listener or listening device, particularly when there is leakage from around the ear canal. With most conventional, non-behind-the-ear hearing aids, amplified sound from the hearing aid is focused more in the lateral and frontal directions, relative to the user. Thus, a user of most conventional behind-the-ear hearing aids would have a chance of seeing a person or device listening to the amplified sounds from the hearing aid, since these sounds tend to be easiest to hear from the user's sides and front.

In a behind-the-ear hearing aid, however, the speaker is usually located behind the user's ear, and a person or listening device located behind the user can sometimes hear amplified sound, such as due to leakage from the hearing aid encasement, without visual detection by the user. In some cases, a receiver button is inserted into the ear canal and is connected by a wire to the hearing aid body.

Thus, there is a need in an EMR-shielded behind-the-ear hearing aid for shielding against leakage of sound, specifically in the audible frequency range of 20 Hz to 20,000 Hz.

SUMMARY OF THE INVENTION

An aspect of the present invention provides a method and a shield for a behind-the-ear hearing aid. The shield includes a shielding material providing effective shielding of electromagnetic radiation in the frequency range of 20 Hz to 1,600 MHz and effective sound shielding in the audio frequency range of 20 Hz to 20,000 Hz.

In another aspect of the invention, the shielding material forms a layer along an interior surface of the hearing aid.

In another aspect of the invention, the shielding material forms a layer along an exterior surface of a hearing aid.

In another aspect of the invention, the effective electromagnetic radiation and audio shielding is at least 75% of the electromagnetic radiation and audio intensities, respectively.

In another aspect of the invention, the shield is comprised of a Mu metal.

In another aspect of the invention, a mould is provided around the hearing canal insert of the shielded behind-the-ear hearing aid as described here, to prevent sound leakage from the hearing canal insert proximal to a user's hearing canal. The hearing canal mould is comprised of rubber or a rubber-like silicone compound, and further includes an inner surface shaped to encompass and seal an outer portion of a hearing tube of the hearing aid and an outer portion shaped to encompass and seal a user's hearing canal entrance.

Another aspect of the invention provides a kit for shielding a behind-the-ear hearing aid. The kit includes a shielding material for providing effective shielding of electromagnetic radiation in the frequency range of 20 Hz to 1,600 MHz and effective sound shielding in the audio frequency range of 20 Hz to 20,000 Hz when installed, an adhesive for bonding the shielding material to an outer surface of the behind-the-ear hearing aid, a hearing canal mould, wherein the hearing canal mould is comprised of a rubber-like silicone compound, and the hearing canal mold further comprises an inner surface shaped to encompass and seal an outer portion of a hearing tube of the hearing aid and an outer portion shaped to encompass and seal a user's hearing canal entrance, and instructions for installing.

In one aspect of the invention, the kit includes two or more preformed and annealed sections comprised of a shielding material for providing effective shielding of electromagnetic radiation in the frequency range of 20 Hz to 1,600 MHz and effective sound shielding in the audio frequency range of 20 Hz to 20,000 Hz when installed, the two or more sections being joined to form a containment around a behind-the ear-hearing aid, and a fastening means for securing the two or more joined sections to one another. Various fastening means are envisioned, including, without limitation: adhesives, bindings hinges, clamps, clasps, and the like.

DETAILED DESCRIPTION

In the following description, for purposes of explanation, specific numbers, materials and configurations are set forth in order to provide a thorough understanding of the invention. It will be apparent, however, to one having ordinary skill in the art, that the invention may be practiced without these specific details. In some instances, well-known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearances of the phrase "in an embodiment" in various places in the specification are not necessarily all referring to the same embodiment.

The term "Mu metal" referred to in the descriptions of various embodiments of the invention herein described is intended to generally refer to alloys having important EMR field shielding characteristics. There is no presently known material that completely blocks the magnetic fields component of EMR fields without itself being attracted to the magnetic force. Generally, magnetic fields can only be redirected, not removed by high-permeability shielding alloys. Alloys useful for magnetic shielding are said to be magnetically "soft" because they can absorb magnetic energy without retaining it. Commercial examples of Mu metal alloys useful for electromagnetic shielding include, but are not limited to Magnetic Shield Corporation's CO-NETIC®, NETIC®, and Mumetal®, AD-Vance Magnetic Inc.'s ADMU® product line, as well as glass-based products produced by MetGlas®, Inc. Mu metals are typically composed of nickel-iron alloys (approximately 75% nickel, 15% iron, plus copper and molybdenum) and are annealed to maximize magnetic shielding properties. Sintered plastic products are also now available which include various EMR shielding materials. Use of these products in the present invention is also envisioned.

The term "effective" used herein with respect to shielding of EMR and sound, e.g. "effective shielding of electromagnetic radiation" and "effective sound shielding", means shielding to at least the extent that the audio cannot be detected by a human ear at a distance of one foot and EMR cannot be distinguished from background noise.

The present invention advantageously provides for EMR shielding for a behind-the-ear hearing aid, specifically in the frequency range of 20 Hz to 1,600 MHz. Note that shielding of lower frequencies generally implies that the higher frequencies are also shielded as well.

The present invention also advantageously provides in an EMR-shielded behind-the-ear hearing aid for shielding against emission of sound, specifically in the audible frequency range of 20 Hz to 20,000 Hz.

Figure 1:
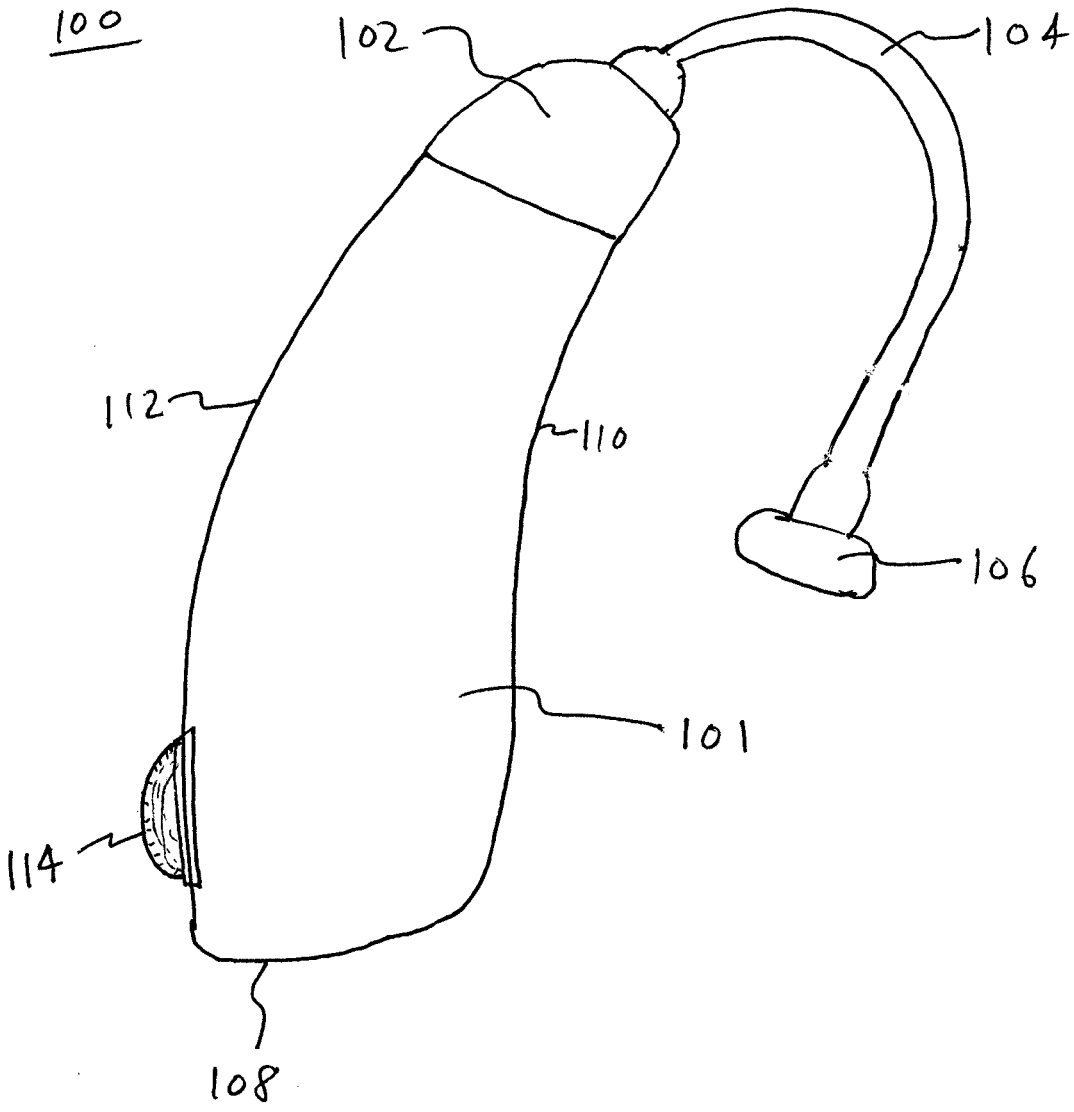
FIG. 1 (PRIOR ART)
FIG. 1 is a schematic diagram illustrating a typical behind-the-ear hearing aid, in accordance with an embodiment of the present invention.

FIG. 1 illustrates an exemplary behind-the-ear hearing aid 100. A typical behind-the-ear hearing aid 100 includes a main body 101, housing the internal components (not depicted), the main body 101 having a base area 108, a curved surface 110 that lies proximal to the user's ear (not depicted), another surface 112 distal from the user's ear, a cap 102 housing a speaker (not depicted), and a sound tube 104 with a terminal earpiece 106, for channeling sound from the speaker to the user's ear canal. There is also usually one or more control mechanisms protruding from the main body 101 for controlling volume and other adjustable features of the hearing aid, such as the volume control wheel 114 depicted herein.

Those of skill in hearing aids will understand that the shape and components of the behind-the-ear hearing aids described here are meant to be representative and not exhaustive of the significant variations found in the shape and components of hearings aids presently in use. It is envisioned that the innovative principles described herein may be employed in hearing aids having other characteristics and components than those described in this specification and its accompanying Figures.

Figure 2:
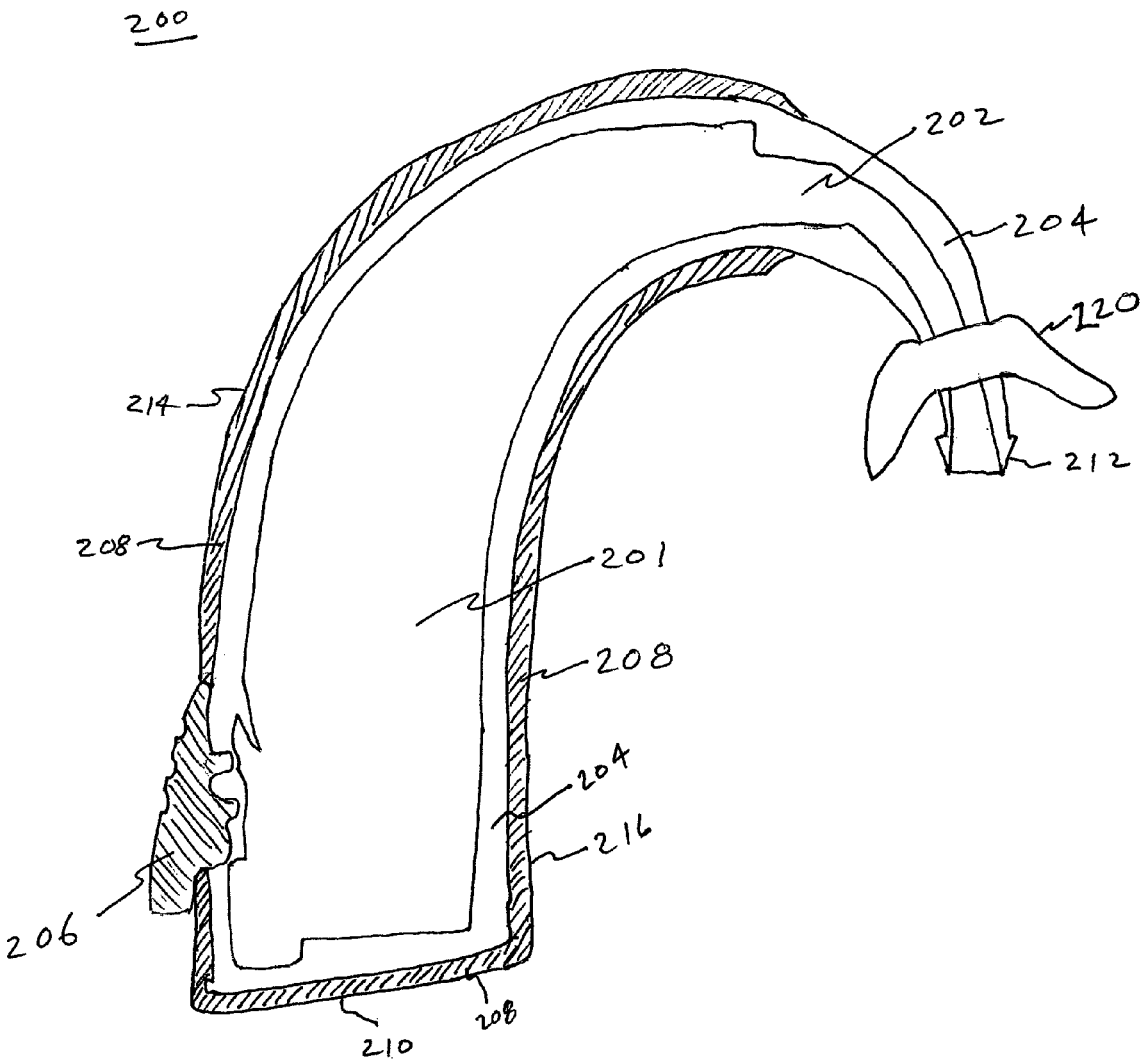
FIG. 2 is a cross-sectional schematic diagram illustrating external application of shielding of a behind-the-ear hearing aid, in accordance with an embodiment of the present invention.

FIG. 2 depicts an exemplary behind-the-ear hearing aid 200 with external application of shielding. In an embodiment of the invention, a shielding material 208, such as a Mu metal is directly bonded to the body of the hearing aid 204. This Mu metal is applied to all the hearing aid's surfaces, including the proximal surface 216, base 210, and distal surface 214. Control mechanisms protruding from the main body of the hearing aid, such as the volume slider 206 shown here, are also preferably formed of Mu metal, or have a Mu metal coating.

In an embodiment of the invention, the Mu metal is shaped to fit the exterior surface of the hearing aid, and applied thereto using an adhesive. Adhesives useful for bonding Mu metals to metallic or plastic surfaces, such as those of hearing aids, are well known in the adhesive industry.

In various embodiments of the invention, the shielding may form a single seamless unit, or may be formed of two or more sections designed to encompass the body of the hearing aid when fit together. It is preferable for both electromagnetic frequency shielding and for audio shielding that the shield have either no or at least a minimal number of gaps, and that any gap be of the smallest possible size. Thus, where two or more sections of shield are fitted together, it is preferable that the seam be tight. Also, where control mechanisms protrude through the body and shield, it is preferable that such control mechanisms create as small as possible a gap in the shield. It would also be preferable for such control mechanisms to be composed of Mu metal.

Regarding the shielding material itself, Mu metals that have been annealed are known to provide maximal electromagnetic/radio frequency shielding. Thus, the shielding material is preferably preformed and annealed.

In embodiments of the invention using two or more sections of shielding material, the sections are joined together using any of a variety of fastening means. For example, the sections may be joined by the use of a suitable adhesive, or by taping or strapping material, which material may also have shielding properties. Also, the sections may be joined using mechanical fasteners, including hinges, clasps, rivets, screws, and the like.

Also in an embodiment of the invention, audio shielding is enhanced by use of a hearing canal mould 220 made of a rubber or rubber-like silicone compound. The hearing canal mould 220 is shaped to fit snugly around the surface of the tube leading from the hearing aid body into the hearing canal, terminating at the hearing canal insert section 212 of the hearing aid. The hearing aid canal mould 220 is also shaped to fit snugly around the entrance to the user's hearing canal, so as to shield from leakage of sound from the interior of the hearing canal and the area of the hearing canal insert section 212.

Embodiments of the present invention use a hearing aid canal mould 220 of various design and of various rubber or rubber-like materials. In a preferred embodiment, the user's ear canal and the area thereabouts can be precisely measured and a customized hearing aid canal mould 220 fashioned to match. This embodiment increased the efficiency of sound shielding and the comfort to the user.

Figure 3:
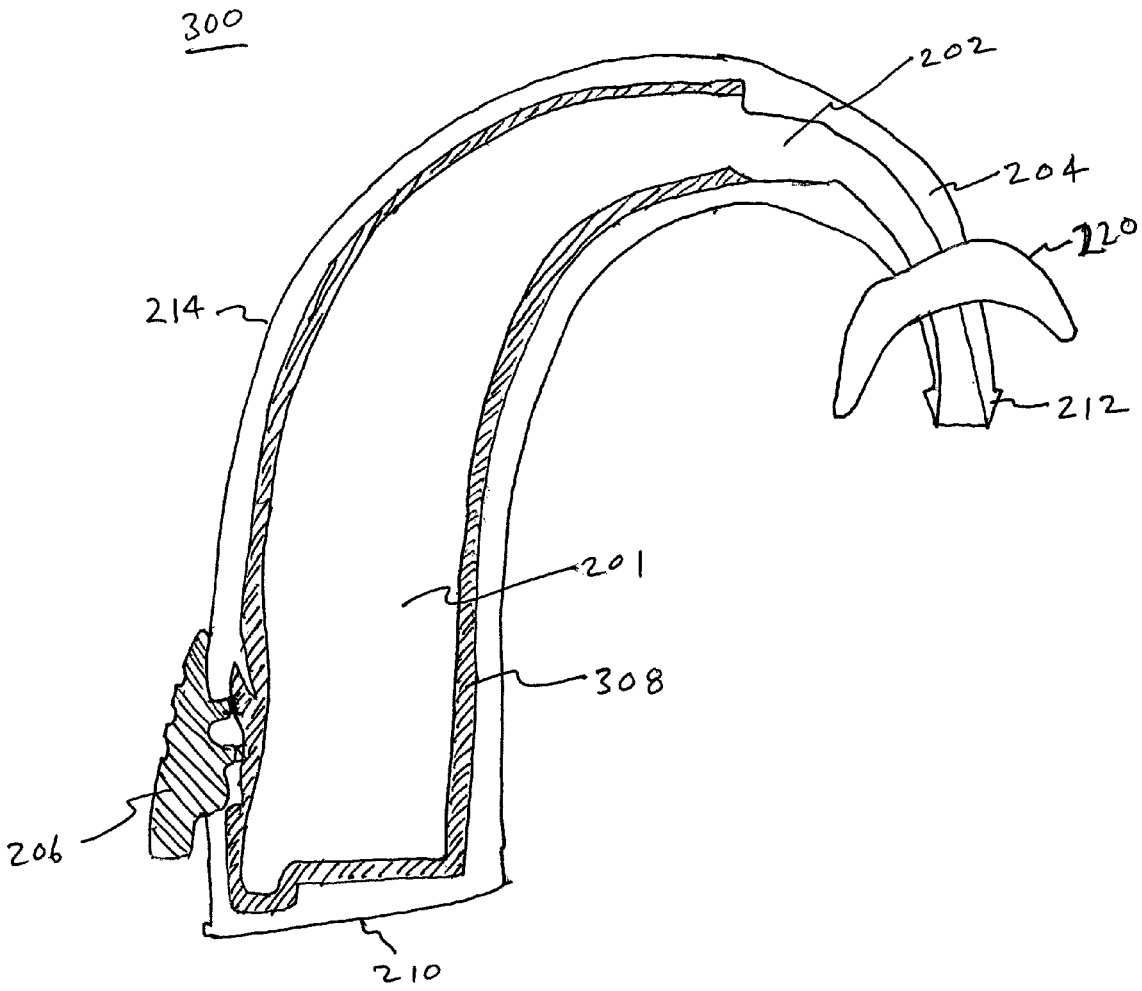
FIG. 3 is a cross-sectional schematic diagram illustrating internal application of shielding of a behind-the-ear hearing aid, in accordance with an embodiment of the present invention.

FIG. 3 depicts an exemplary behind-the-ear hearing aid 200 with shielding material 308 applied internal to the main body 204. In an embodiment of the invention, the shielding material 308 directly surrounds the internal electrical components, and the body of the hearing aid 204 is then placed around the shielding material. As with embodiments using external shielding material, the outer layer, in this case the body 204, may be attached by any method, and also may comprise more than one section. Also, control mechanisms that protrude through the shielding material 308 are preferably made themselves of shielding material, and any gaps they leave in the shielding material 308 are minimized so as to maximize overall shielding. A hearing aid canal mould 220 may also be provided.

Figure 4:
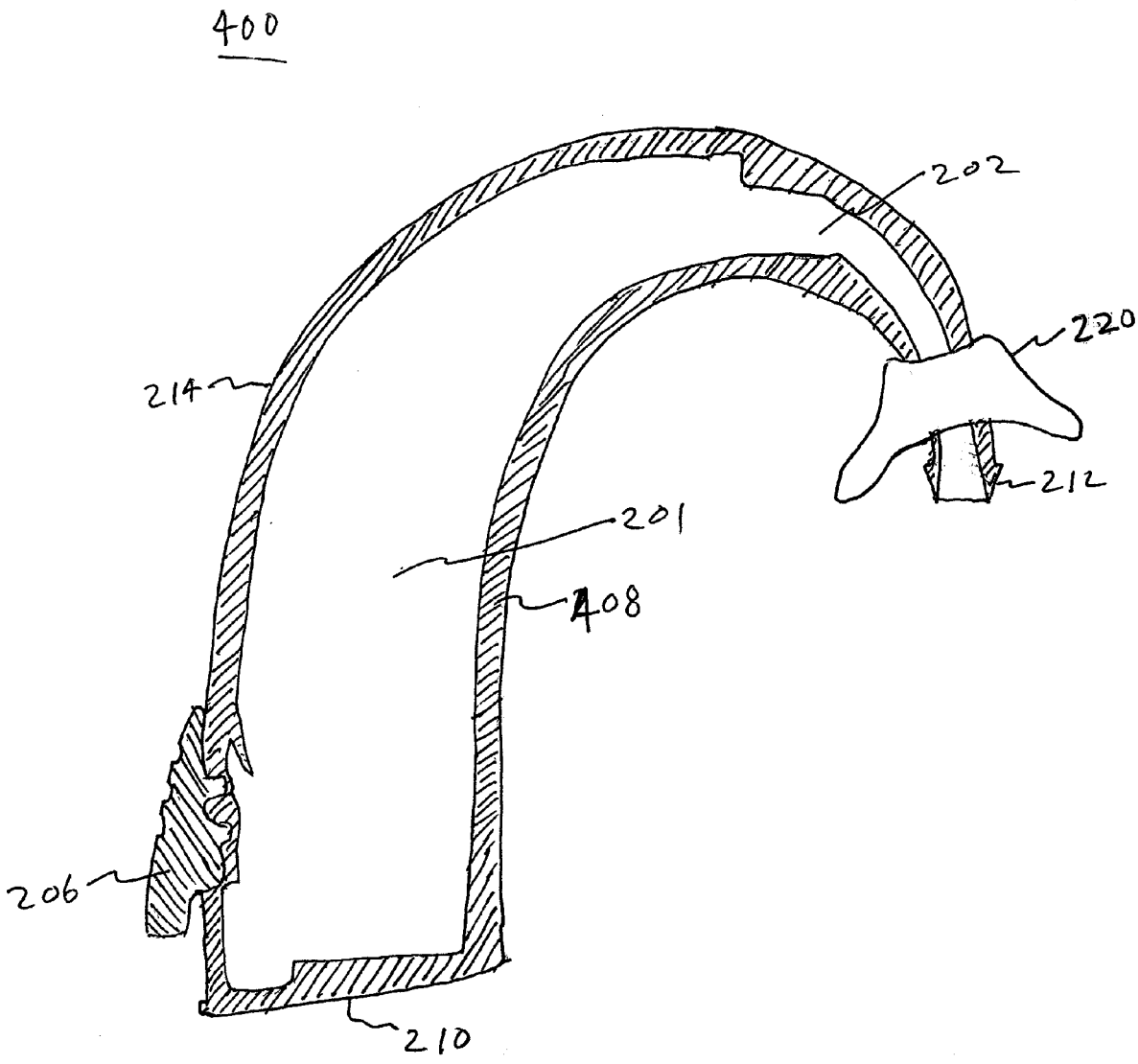
FIG. 4 is a cross-sectional schematic diagram illustrating a behind-the-ear hearing aid having an encasement formed from a shielding material, in accordance with an embodiment of the present invention.

FIG. 4 depicts an exemplary behind-the-ear hearing aid 400 having an encasement 408 formed from a shielding material. In an embodiment of the invention, the hearing aid body itself, the encasement 408 is actually formed from shielding material. This arrangement offers the advantage of minimizing seams or gaps in the shielding material. As in the above embodiments, control mechanisms protruding through the encasement 408, such as slider 206, preferably are designed to leave minimal gaps in the shielding. In an embodiment, these mechanisms are themselves made from shielding material. A hearing aid canal mould 220 may also be provided.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A shield for a behind-the-ear hearing aid, the shield comprising a shielding material providing effective shielding of electromagnetic radiation in the frequency range of 20 Hz to 1,600 MHz and effective sound shielding in the audio frequency range of 20 Hz to 20,000 Hz;

wherein the shielding material comprises a Mu metal and is arranged to provide complete shielding with no gaps in coverage.

2. The shield according to claim 1, wherein the shielding material forms a layer along an interior surface of the hearing aid.

3. The shield according to claim 1, wherein the shielding material forms a layer along an exterior surface of a hearing aid.

4. The shield according to claim 1, wherein effective electromagnetic radiation and audio shielding is at least 75% of the electromagnetic radiation and audio, respectively.

5. The shield according to claim 1, further comprising a hearing canal mould, wherein the hearing canal mould is comprised of a rubber-like silicone compound, and the hearing canal mold further comprises an inner surface shaped to encompass and seal an outer portion of a hearing tube of the hearing aid and an outer portion shaped to encompass and seal a user's hearing canal entrance.

6. A method for shielding a behind-the-ear hearing aid, the method comprising encompassing a plurality of electromagnetic, radio and sound wave producing components with a shielding material comprising a Mu metal providing effective shielding of electromagnetic radiation in the frequency range of 20 Hz to 1,600 MHz and effective sound shielding in the audio frequency range of 20 Hz to 20,000 Hz; and wherein the shielding material is arranged to provide complete shielding with no gaps in coverage.

7. The method according to claim 6, wherein the shielding material forms a layer along an interior surface of the hearing aid.

8. The method according to claim 6, wherein the shielding material forms a layer along an exterior surface of the hearing aid.

9. The method according to claim 6, wherein the effective electromagnetic radiation and audio shielding is at least 75% of the electromagnetic radiation and audio, respectively.

10. The method according to claim 6, further comprising providing a hearing canal mould, wherein the hearing canal mould is comprised of a rubber-like silicone compound, and the hearing canal mold further comprises an inner surface shaped to encompass and seal an outer portion of a hearing tube of the hearing aid and an outer portion shaped to encompass and seal a user's hearing canal entrance.

11. A kit for shielding a behind-the-ear hearing aid, the kit comprising:

a shielding material comprising a Mu metal for providing effective shielding of electromagnetic radiation in the frequency range of 20 Hz to 1,600 MHz and effective sound shielding in the audio frequency range of 20 Hz to 20,000 Hz when installed;

an adhesive for bonding the shielding material to an outer surface of the behind-the-ear hearing aid leaving no gaps in coverage;

a hearing canal mould, wherein the hearing canal mould is comprised of a rubber-like silicone compound, and the hearing canal mold further comprises an inner surface shaped to encompass and seal an outer portion of a hearing tube of the hearing aid and an outer portion shaped to encompass and seal a user's hearing canal entrance; and instructions for installing the shielding material on the behind-the-ear hearing aid and for installing the hearing canal mold.

12. The kit according to claim 11, wherein the effective electromagnetic radiation and audio shielding is at least 75% of the electromagnetic radiation and audio, respectively.

13. A kit for shielding a behind-the-ear hearing aid, the kit comprising:

two or more preformed and annealed sections comprised of a shielding material comprising a Mu metal for providing effective shielding of electromagnetic radiation in the frequency range of 20 Hz to 1,600 MHz and effective sound shielding in the audio frequency range of 20 Hz to 20,000 Hz when installed, the two or more sections being joined to form a containment around a behind-the ear-hearing aid;

a hearing canal mould, wherein the hearing canal mould is comprised of a rubber-like silicone compound, and the hearing canal mold further comprises an inner surface shaped to encompass and seal an outer portion of a hearing tube of the hearing aid and an outer portion shaped to encompass and seal a user's hearing canal entrance; and a fastening means for securing the two or more joined sections to one another leaving no gaps in shielding.

14. The kit according to claim 13, wherein the fastening means is an adhesive.

15. The kit according to claim 13, wherein the fastening means is a binding wrapped around the joined sections.

16. The kit according to claim 13, wherein the fastening means is a hinge and clasp mechanism.

17. A shield for a behind-the-ear hearing aid, the shield comprising a Mu metal shielding material bonded to the external surface of the behind-the-ear hearing aid leaving no gaps in shielding coverage, the shielding providing effective shielding of electromagnetic radiation in the frequency range of 20 Hz to 1,600 MHz and effective sound shielding in the audio frequency range of 20 Hz to 20,000 Hz.

* * * * *